US007225563B2

(12) United States Patent
Chen et al.

(10) Patent No.: US 7,225,563 B2
(45) Date of Patent: Jun. 5, 2007

(54) SHOE WITH ADJUSTABLE FITTING

(75) Inventors: Eddie Chen, 9F, No. 201, Sec. 1, Taichung-Kang Rd., Taichung (TW); Charlie Chen, Taichung (TW); Paul Yang, Taichung (TW)

(73) Assignee: Eddie Chen, Taichung (TW)

( * ) Notice: Subject to any disclaimer, the term of this patent is extended or adjusted under 35 U.S.C. 154(b) by 226 days.

(21) Appl. No.: 10/916,259

(22) Filed: Aug. 10, 2004

(65) Prior Publication Data

US 2006/0032090 A1 Feb. 16, 2006

(51) Int. Cl.
*A43B 23/28* (2006.01)

(52) U.S. Cl. ..... 36/58.5; 36/88; 36/93; 36/10; 36/55; 36/50.1

(58) Field of Classification Search ..... 36/58.5, 36/58.6, 88, 93, 97, 71, 69, 92, 10, 55, 89, 36/50.1

See application file for complete search history.

(56) References Cited

U.S. PATENT DOCUMENTS 920,680 A * 5/1909 Southwick ..... 36/58.5
1,247,467 A * 11/1917 Strauss ..... 36/3 A
1,408,721 A * 3/1922 Carrel ..... 36/58.5
1,781,197 A * 11/1930 Schroeter ..... 36/58.5
1,845,031 A * 2/1932 Arthur ..... 36/140
3,234,667 A * 2/1966 Bovay ..... 36/113
3,419,974 A * 1/1969 Lange ..... 36/117.6
3,566,486 A * 3/1971 Conway ..... 36/114
4,366,631 A * 1/1983 Larsen et al. ..... 36/50.1
4,385,456 A * 5/1983 Livernois et al. ..... 36/115
4,726,126 A * 2/1988 Bernhard ..... 36/89
5,746,015 A * 5/1998 Clement et al. ..... 36/93
5,946,827 A * 9/1999 Okajima ..... 36/58.5

* cited by examiner

*Primary Examiner*—Marie Patterson
(74) *Attorney, Agent, or Firm*—DLA Piper US LLP

(57) ABSTRACT

A shoe includes an upper having a heel portion that has a rear wall adapted to extend around the heel of a foot. At least one adjustment pad is attached loosely to the rear wall within the heel portion. The adjustment pad includes an intermediate part, first and second ends on two opposite sides of the intermediate part, a first surface confronting the rear wall, and a second surface opposite to the first surface. A strap passage unit is provided on the rear wall. A strap is attached to the adjustment pad, and passes movably through the strap passage unit. When the strap is pulled to move through the strap passage unit, the strap is tensed, and the adjustment pad is moved inward so as to abut against the foot in the shoe.

8 Claims, 10 Drawing Sheets

SHOE WITH ADJUSTABLE FITTING

BACKGROUND OF THE INVENTION

1. Field of the Invention

The invention relates to a shoe, more particularly to a shoe having with an adjustment unit for adjusting the fitting of the shoe.

2. Description of the Related Art

Referring to FIG. 1, a conventional shoe 1 is shown to include an outsole 11, an upper 12, and a sole pad 13.

An upper side of the outsole 11 and the upper 12 cooperatively define a receiving chamber 14. The sole pad 13 is fitted in the receiving chamber 14. In use, after the wearer puts his foot into the receiving chamber 14 of the shoe 1, a shoelace (not shown) usually provided on the shoe 1 is tightened to prevented slippage of the shoe 1 and to protect the wearer's foot. The shoelace helps prevent slippage of the shoe because the shoelace is provided at an instep part of the upper 12 such that when the shoelace is tightened, an opening of the receiving chamber 14 can be contracted to prevent slippage of the shoe 1.

However, although the shoe 1 can be prevented from slipping off the wearer's foot, since a heel part of the upper 12 is not provided with any tightening means, a heel 15 of the wearer may twist relative to the wearer's shin due to movement of the wearer's ankle when the wearer exercises, thereby resulting in injury to the wearer's ankle.

It is known in the art to provide an embedded soft pad in the heel part of the upper for positioning the heel of the wearer. However, the shoe is relatively difficult to put on or take off due to the height and thickness of the pad at the heel part. Besides, the pad will deform after a period of use, and the upper will likewise become slackened, thereby affecting adversely the heel positioning effect of the shoe.

SUMMARY OF THE INVENTION

Therefore, the object of the present invention is to provide a shoe with an adjustment unit that can fit around the wearer's heel to enhance the fitness of the shoe and to protect the wearer's ankle.

According to one aspect of this invention, a shoe comprises an upper including a front portion and a heel portion which has a rear wall adapted to extend around the heel of a foot. At least one adjustment pad is attached loosely to the rear wall within the heel portion. The attachment pad includes an intermediate part, first and second ends on two opposite sides of the intermediate part, a first surface confronting the rear wall, and a second surface opposite to the first surface. A strap passage unit is provided on the rear wall. A strap is attached to the adjustment pad, and passes movably through the strap passage unit. When the strap is pulled to move through the strap passage unit, the strap is tensed, and the adjustment pad is moved inward for abutment against the foot in the shoe.

According to another aspect of this invention, a shoe comprises an upper, at least one adjustment pad, first and second strap passage units, and a strap. The upper includes a front portion, a heel portion which has a rear wall adapted to extend around the heel of a foot, and an instep part provided with a shoelace. The adjustment pad is attached loosely to the rear wall within the heel portion, and includes an intermediate part, first and second ends on two opposite sides of the intermediate part, a first surface confronting the rear wall, and a second surface opposite to the first surface. The first and second strap passage units are provided on the rear wall. The first strap passage unit is proximate to the second end of the adjustment pad. The strap includes a first section connected to the first surface of the adjustment pad at least at a location adjacent to the second end, and a second section passing through the first and second strap passage units. The second section has one end extending out of the upper and connected to the shoelace. When the shoelace is tightened, the strap is pulled and tensed between the first and second passage units and moves inward the adjustment pad so that the adjustment pad is capable of abutting tightly against the foot in the shoe.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
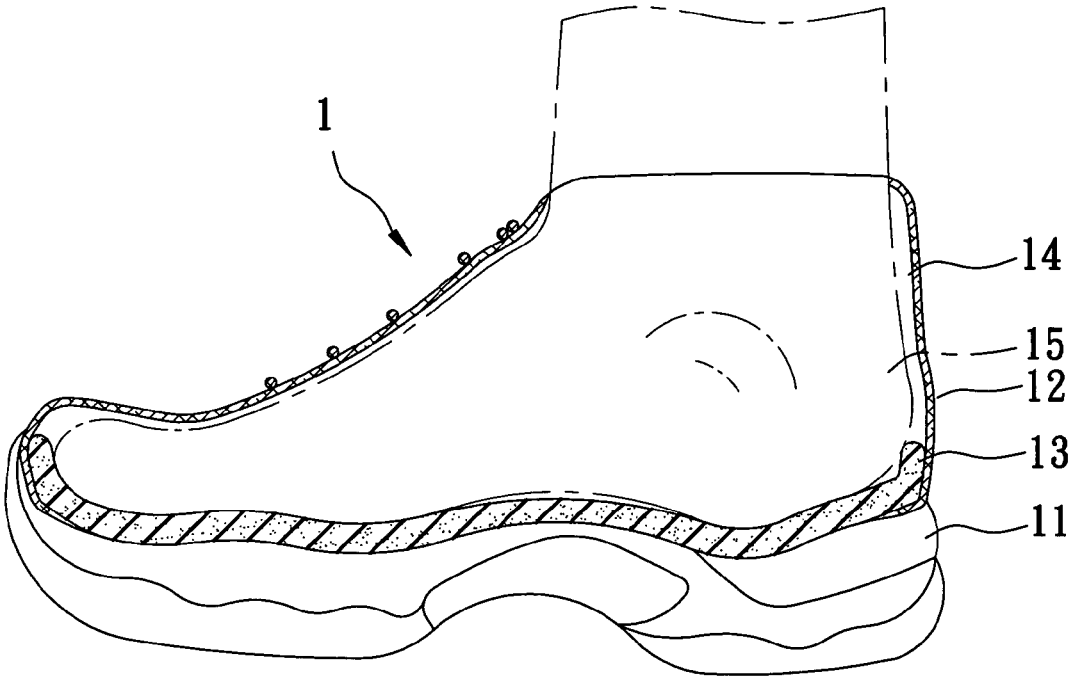
FIG. 1 PRIOR ART
FIG. 1 is a partly sectioned schematic side view of a conventional shoe.
Figure 2:
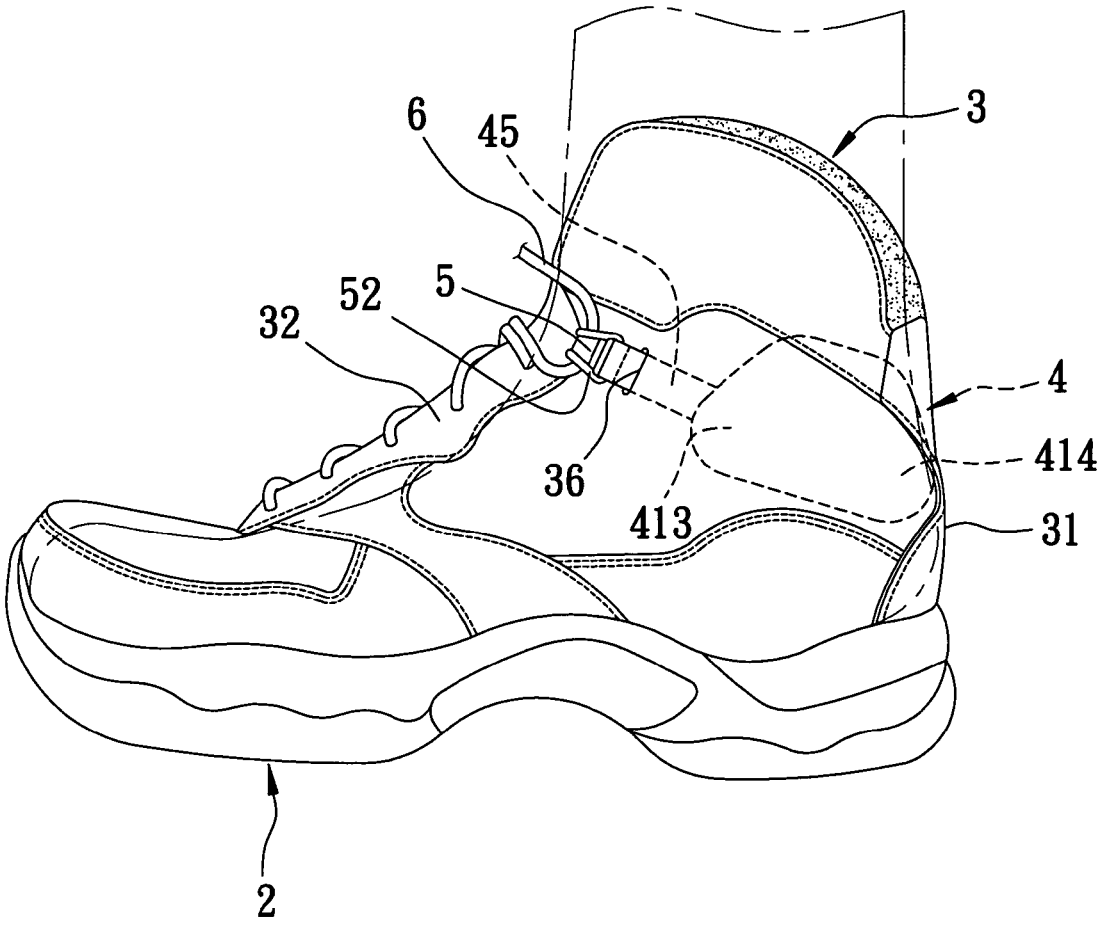
FIG. 2 is a schematic side view showing the first preferred embodiment of a shoe according to this invention.

Before the present invention is described in greater detail, it should be noted that like elements are denoted by the same reference numerals throughout the disclosure.

Referring to FIGS. 2, 3A, 3B and 3C, the preferred embodiment of a shoe according to this invention is shown to include an outsole 2, an upper 3, an adjustment unit, and two straps 45.

The upper 3 extends upward from an outer periphery of the outsole 2, and includes a front portion, a heel portion which has a rear wall 31 adapted to extend around the heel of the wearer's foot, and an instep part 32 provided with a shoelace 6. The upper 3 and the outsole 2 cooperatively confine a receiving chamber 33 for receiving the wearer's foot.

The adjustment unit includes two adjustment pads 4, which are adapted to be disposed on two sides of the ankle of the wearer's foot and which may be made from a soft resilient material or any other suitable material that can provide a comfortable or soft feeling for the wearer.

Each of the adjustment pads 4 is attached loosely to the rear wall 31 within the heel portion of the upper 3, and includes an intermediate part 415, first and second ends 413, 414 on two opposite sides of the intermediate part 415, a first surface 412 confronting the rear wall 31, and a second surface 411 opposite to the first surface 412 and confronting the receiving chamber 33. Each adjustment pad 4 is elongate from the first end 413 to the second end 414, and extends in a direction from the heel portion toward the front portion. The second end 414 is disposed proximate to a rear end of the rear wall 31, whereas the first end 413 extends away from the second end 414 in a direction toward the front portion of the upper 3. The intermediate part 415 is configured to have a portion with a reduced thickness so as to provide an increased flexibility at the intermediate part 415. Of course, the design of intermediate part 415 depends on the practical requirement of the adjustment pad 4. For example, a small thickness is required for the intermediate part 415 when the adjustment pad 4 is rather thick. Each adjustment pad 4 is attached to the rear wall 31 by a connecting member 42, which has one end attached to the rear wall 31 and another end attached to the respective adjustment pad 4 adjacent to the first end 413 thereof. Besides, the connecting member 42 can also be attached to the first surface 412 at any position. In this embodiment, the connecting member 42 is an elastic strip.

Each of the straps 45 is made of a textile material, and is attached to the first surface 412 of the respective adjustment pad 4. Each strap 45 includes a first section 451 and a second section 452. The first section 451 extends from the first end 413 to the second end 414 on the first surface 412 of the respective adjustment pad 4.

Figure 3A:
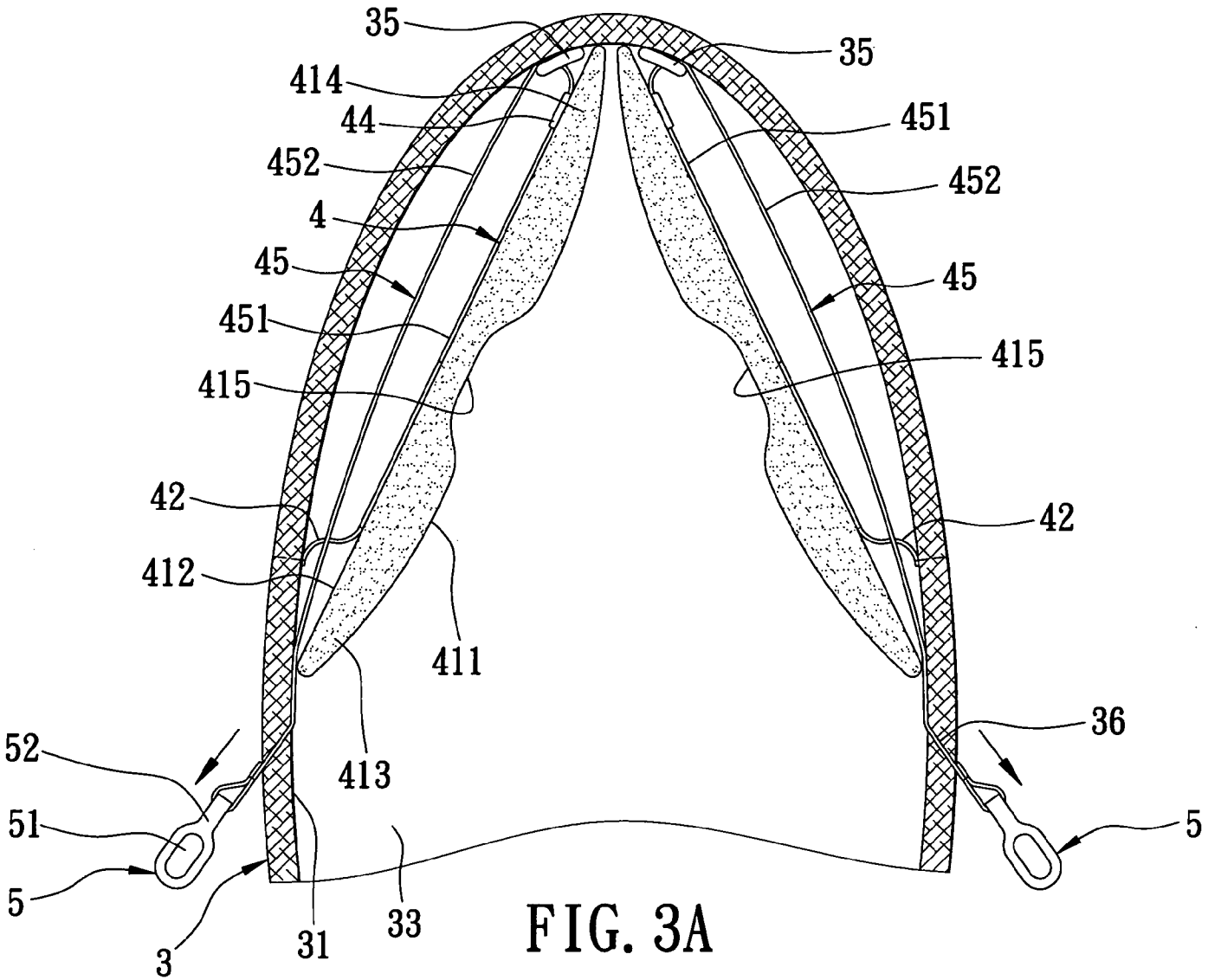
FIG. 3A is a fragmentary top view of the first preferred embodiment.
Figure 3B:
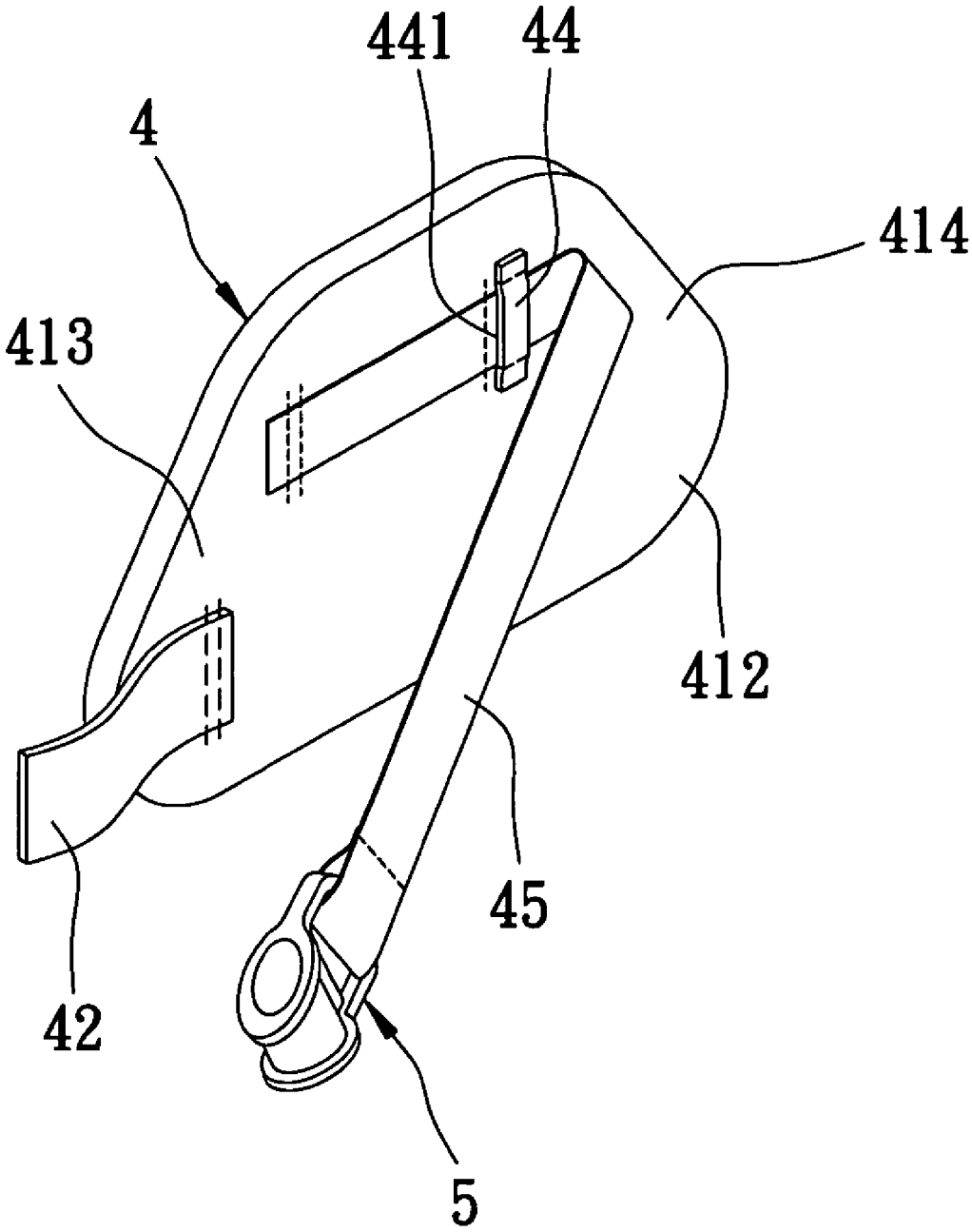
FIG. 3B is a perspective view showing an adjustment pad used in the first preferred embodiment.
Figure 3C:
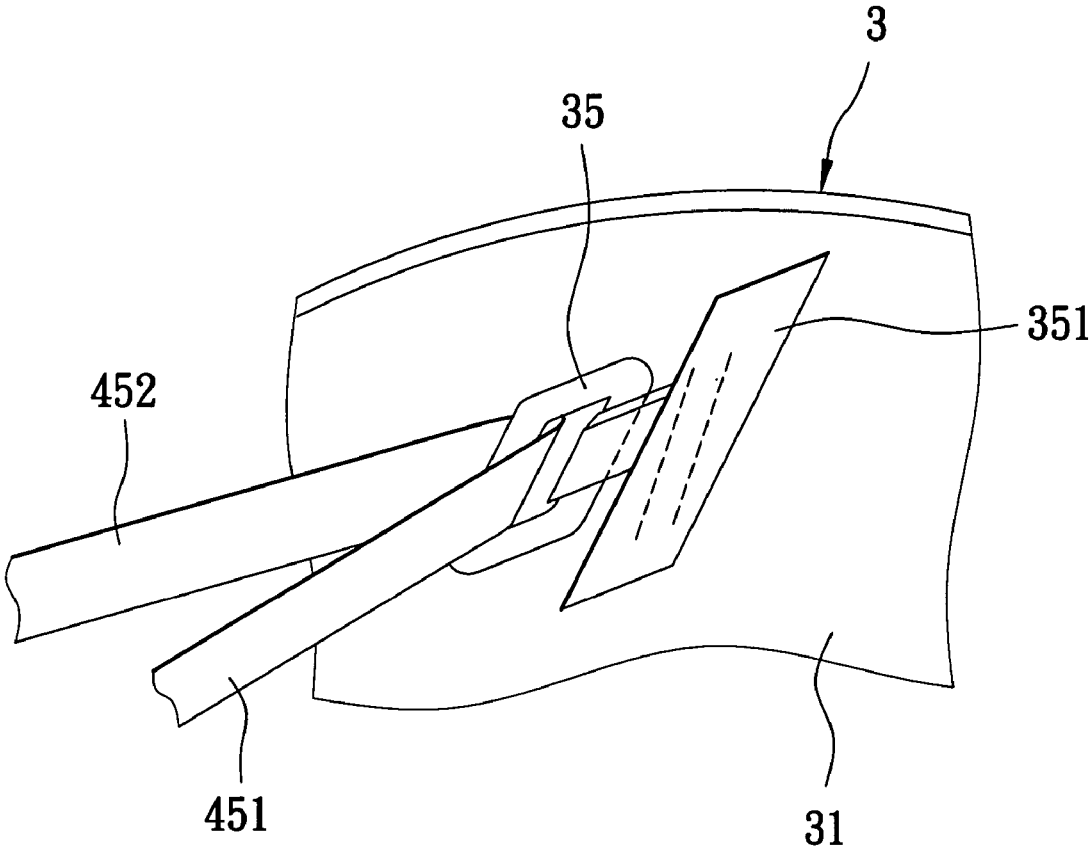
FIG. 3C is a fragmentary perspective view showing an encircled portion of the first embodiment shown in FIG. 3A.

Each of the straps 45 is arranged to pass through first and second strap passage units, one being a ring member 35 and the other being a through hole 36. Alternatively, the strap passage units may be any other type of passage means which can provide passage for the strap 45 to pass and slide through. The ring member 35 is attached to the rear wall 31 adjacent to the second end 414 of the respective adjustment pad 4 for passage of the corresponding strap 45. The attachment of the ring member 35 to the rear wall 31 may be accomplished through an attachment strap 351 sewn to the rear wall 31 as shown in FIG. 3C, or through any other suitable attachment means. The through hole 36 is formed in the rear wall 31 for outward extension of the corresponding strap 45. The first end 413 of each of the adjustment pads 4 is located between the ring member 35 and the through hole 36.

The second section 452 of each of the straps 45 passes through the ring member 35 adjacent to the second end 414 of the respective adjustment pad 4, and then passes through the through hole 36 such that an outer end thereof extends out of the upper 3 for connection with an eyelet member 5. Each strap 45 is folded between the first and second sections 451, 452 adjacent to the second end 414 of the respective adjustment pad 4.

The eyelet member 5 includes an eyelet 51 for passage of the shoelace 6, and a loop 52 for connection with the second section 452 of the respective strap 45, thereby enabling the second section 452 to be connected to the shoelace 6. While the shoelace S is exemplified as a means for pulling the straps 45 in this embodiment, any other means which is connected to the upper 3 and which is operable to apply a pulling force to the straps 45, such as fastening straps incorporating a fastening tape consisting of a strip of minute hooks that fasten to a corresponding strip with a surface of uncut pile sold under the trademark Velcro@ or any other fasteners, way be used in place of the shoelace 6.

Each adjustment pad 4 further includes a retainer 44 attached to the first surface 412 adjacent to the second end 414 thereof. In this embodiment, the retainer 44 includes a short strip having two ends attached or sewn to the first surface 412 of the respective adjustment pad 4. An aperture 441 is thus formed between the short strip and the first surface 412, as best shown in FIG. 3B. Of course, the retainer 44 may be any other suitable type of retaining means which can retain the first section 451 of the strap 45 on the adjustment pad 4. For instance, the retaining means may be one which is incorporated into the adjustment pad 4 in order to simplify the construction. The first section 451 of each of the straps 45 is fixed or stitched at "s" (see FIG. 4) to the first surface 412 of the respective adjustment pad 4 adjacent to the first end 413, and extends through the aperture 441 of the retainer 44 of the respective adjustment pad 4 adjacent to the second end 414 for subsequent passage through the ring member 35 so that the first section 451 is retained on the first surface 412 by the retainer 44.

Figure 4:
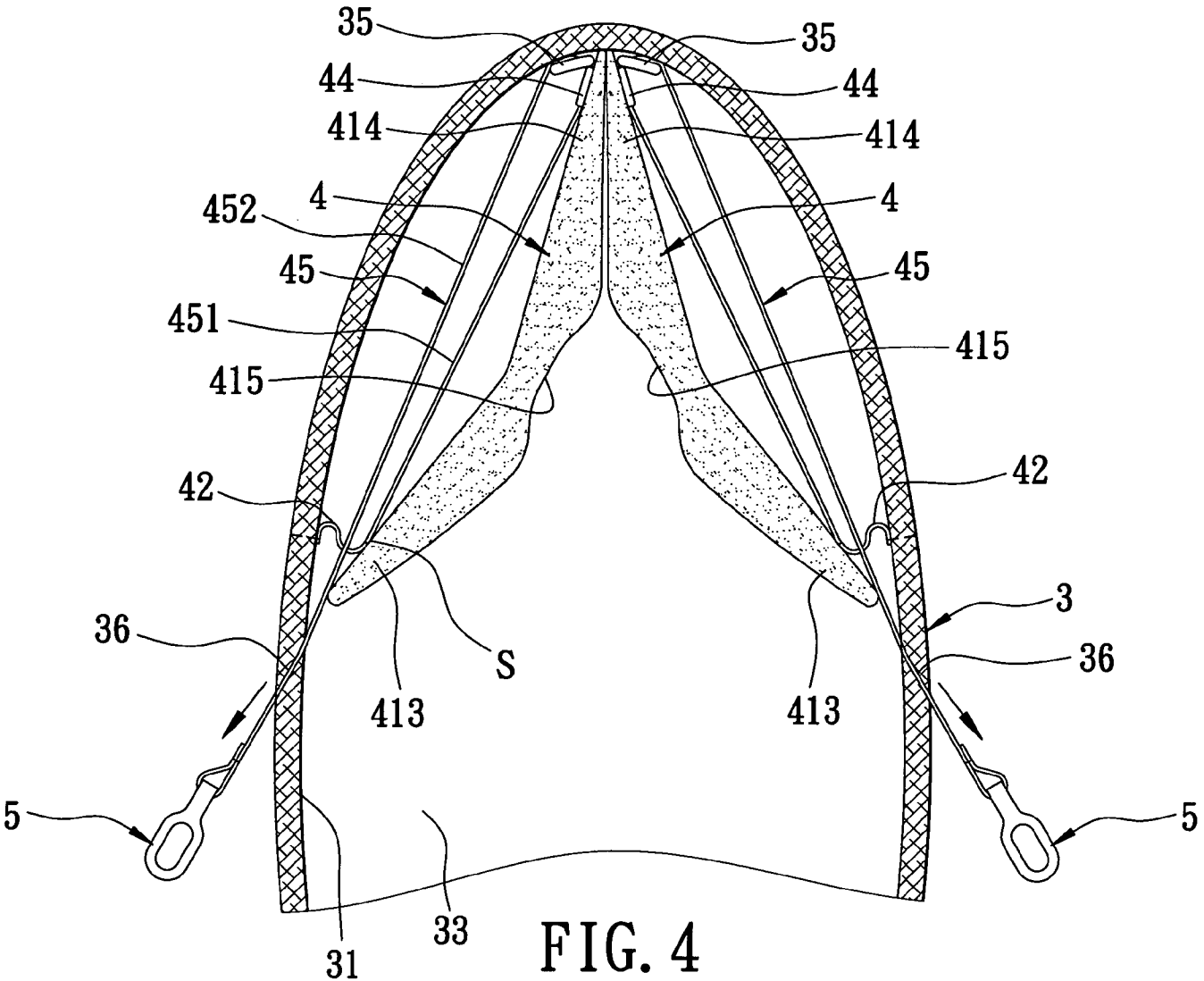
FIG. 4 is the same view as FIG. 3A but with the straps being tensed.

With further reference to FIG. 4, in use, when the shoelace 6 passing through the eyelet members 5 that are associated with the straps 45 is pulled in a tightening operation, the straps 45 are simultaneously pulled. As the retainer 44 of each of the adjustment pads 4 serves to retain the respective strap 45 on the first surface 412 of the respective adjustment pad 4 proximate to the second end 414, when the respective strap 45 is pulled to move through the ring member 35, it is stopped by the retainer 44. In other words, the retainer 44 abuts the ring member 35. When the strap 45 becomes tensed between the ring member 35 and the through hole 36 and between the retainer 44 and the end of the first section 451 of the strap 45 which is stitched at "s" to the adjustment pad 4, the first end 413 of the respective adjustment pad 4 is moved inward by the tensed strap 45 and the intermediate part 415 of the adjustment strap 45 is bent and arched to abut against the ankle of the wearer's foot.

The purpose of fixing the first section 451 of the strap 45 to the adjustment pad 4 at "s" is to allow the strap 45 to bring the first end 413 of the adjustment pad 4 toward the second end 414 along the rear wall 31. On the other hand, the retainer 44 according to the invention performs the following two main functions:

1. A stop function: The retainer 44 will stop at the ring member 35 so that further movement of the second end 414 of the adjustment pad 4 is limited even when the straps 45 are pulled further and tensed.

2. A support function for the adjustment pad 4: As the retainer 44 is stopped by the ring member 35, further pulling of the straps 45 will cause the first section 451 of the strap 45 to slide through the retainer 44 and become tensed between point "s" and the retainer 44, thereby bending and protruding inward the adjustment pad 4. At this juncture, the retainer 44 serves as a supporting point for the adjustment pad 4.

The presence of the reduced thickness in the intermediate part 415 aids the adjustment pad 4 in bending or arching inward. As the adjustment pads 4 are brought to bend toward the receiving chamber 33 by the tensed straps 45, they fit snugly around the wearer's heel to protect the wearer's ankle. When the shoelace 6 is loosened, the adjustment pads 4 are restored to their original positions by the elastic connecting members 42 and will not obstruct the foot when the shoe is taken off.

Figure 5:
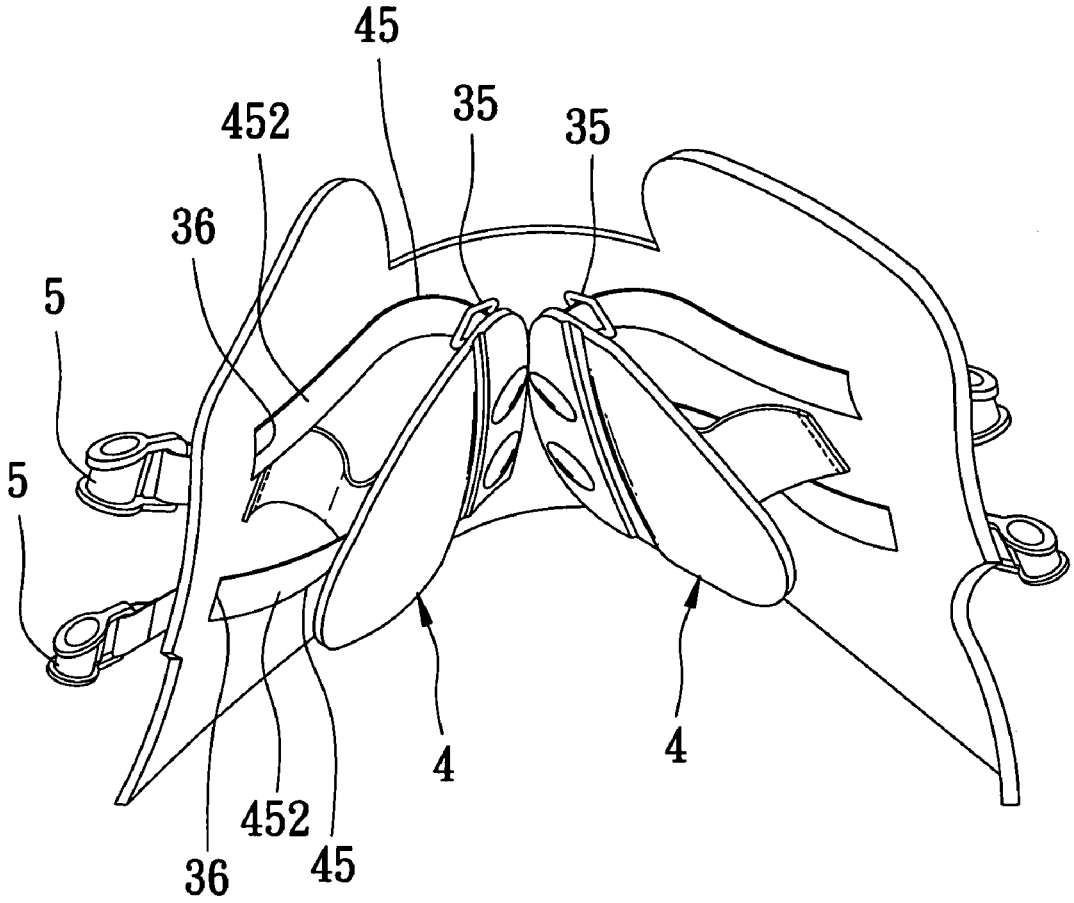
FIG. 5 is a fragmentary perspective view of the second preferred embodiment of a shoe according to this invention.
Figure 6:
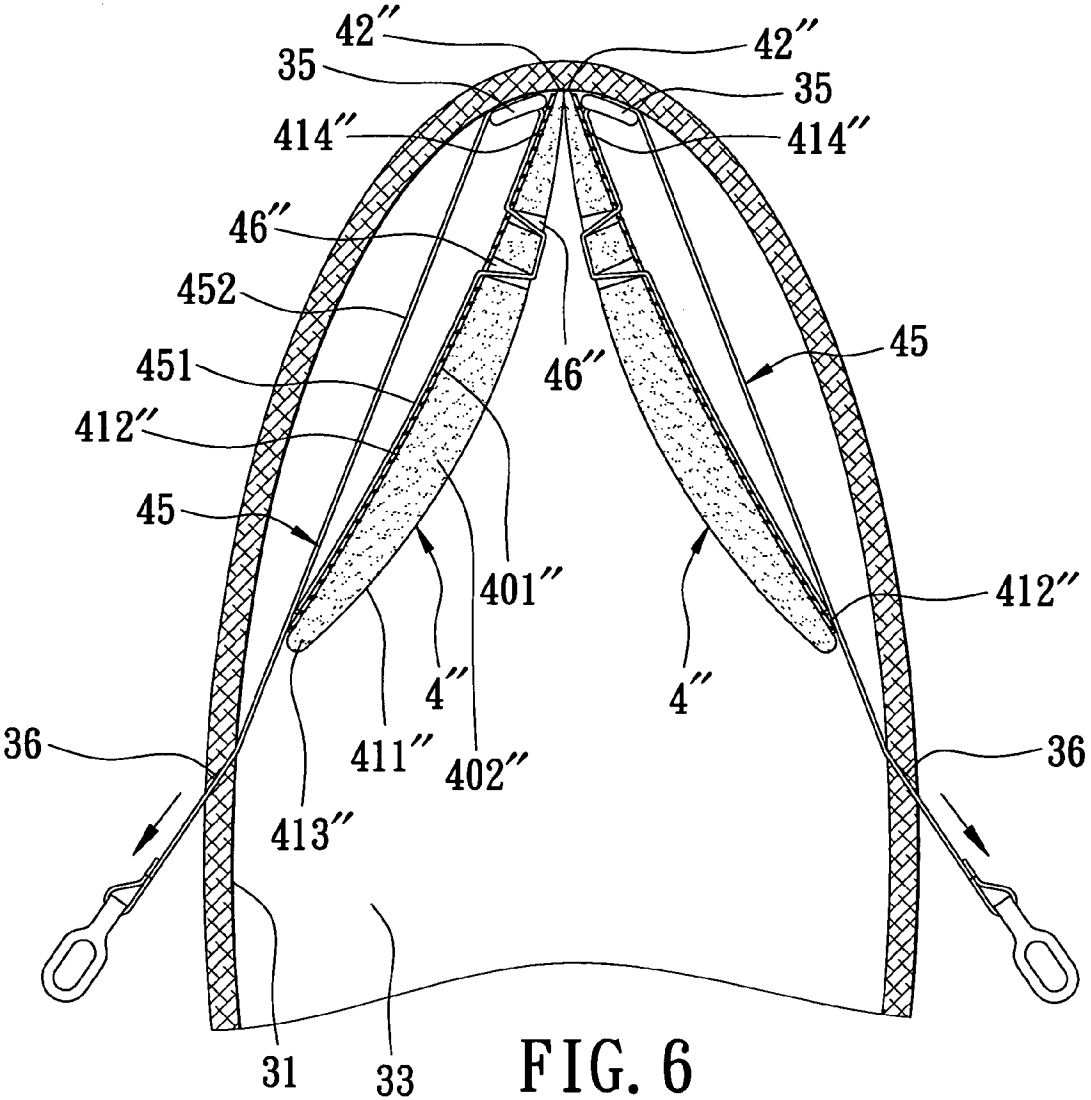
FIG. 6 is a fragmentary top view showing the third preferred embodiment of a shoe according to this invention.

Referring to FIG. 5, the second preferred embodiment of a shoe according to this invention is shown to be substantially similar to the first preferred embodiment in construction. The differences reside mainly in that two straps 45 are used to attach to upper and lower parts of each of the adjustment pads 4, and that two ring members 35 and two through holes 36 are provided. The second sections 452 of the two straps 45 are respectively connected to two eyelet members 5 so as to be associated with the shoelace (not shown). Thus, when the shoelace is pulled and tightened, the two straps 45 are tensed to bring the respective adjustment pad 4 to move toward the wearer's heel. Referring to FIG. 6, the third preferred embodiment of a shoe according to this invention is shown to be substantially similar to the first preferred embodiment. However, in this embodiment, each of the adjustment pads 4" includes a backing 401" and a foam pad 402" overlying the backing 401". The backing 401" may be fabricated through various processes such as molding or cutting methods. An ideal material for the backing 401" is one which is able to provide a returning force or elastic force when the adjustment pad 4" is bent or deformed. This returning force will restore the deformed adjustment pad 4" to its original state automatically once the strap 5 is released. Each of the adjustment pads 4" includes two slots 46" extending through the respective adjustment pad 4" from the first surface 412" to the second surface 411" adjacent to the second end 414" to serve as a retainer for the respective strap 45. The first section 451 of each of the straps 45 extends through one of the slots 46" from the first surface 412" to the second surface 411" and then through the other one of the slots 46" from the second surface 411" to the first surface 412". The connecting member 42" in this embodiment is a stitch member provided at the second end 414" of each of the adjustment pads 4" to fasten the second end 414" to the rear wall 31. When the straps 45 are pulled and tensed, the second ends 413" of the adjustment pads 4" are moved inward by the tensed straps 45. Unlike the connecting member 42 in the first preferred embodiment, the connecting member 42" need not be elastic because the backing 401" of adjustment pad 4" can provide a returning force like the connecting member 42. Moreover, the connecting member 42" in this embodiment provides an additional function to serve as a supporting point for the adjustment pad 4" and allows the adjustment pad 4" to stay at a fixed place regardless of whether the strap 45 is tensed or released.

Figure 7:
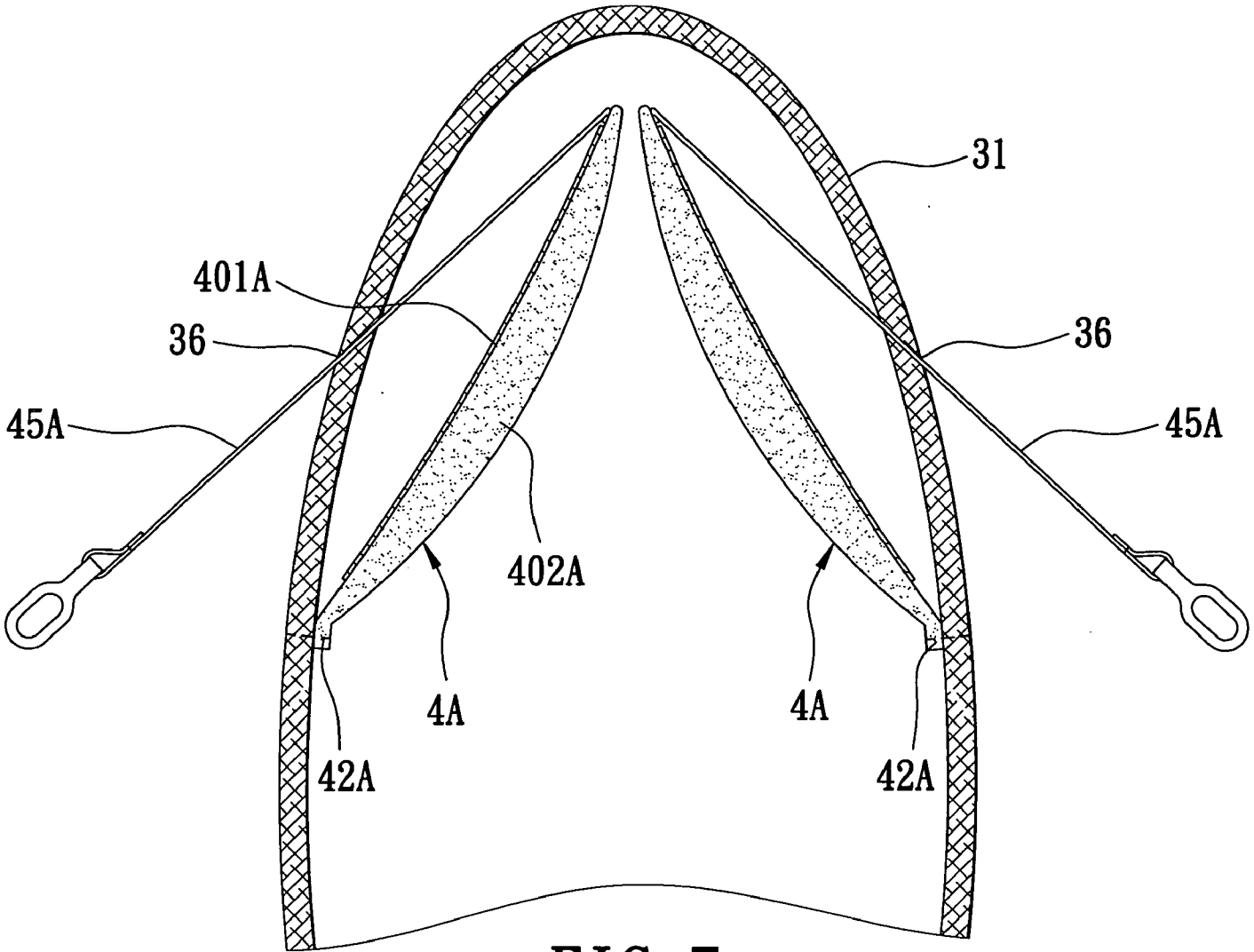
FIG. 7 is a schematic view of the fourth preferred embodiment.
Figure 8:
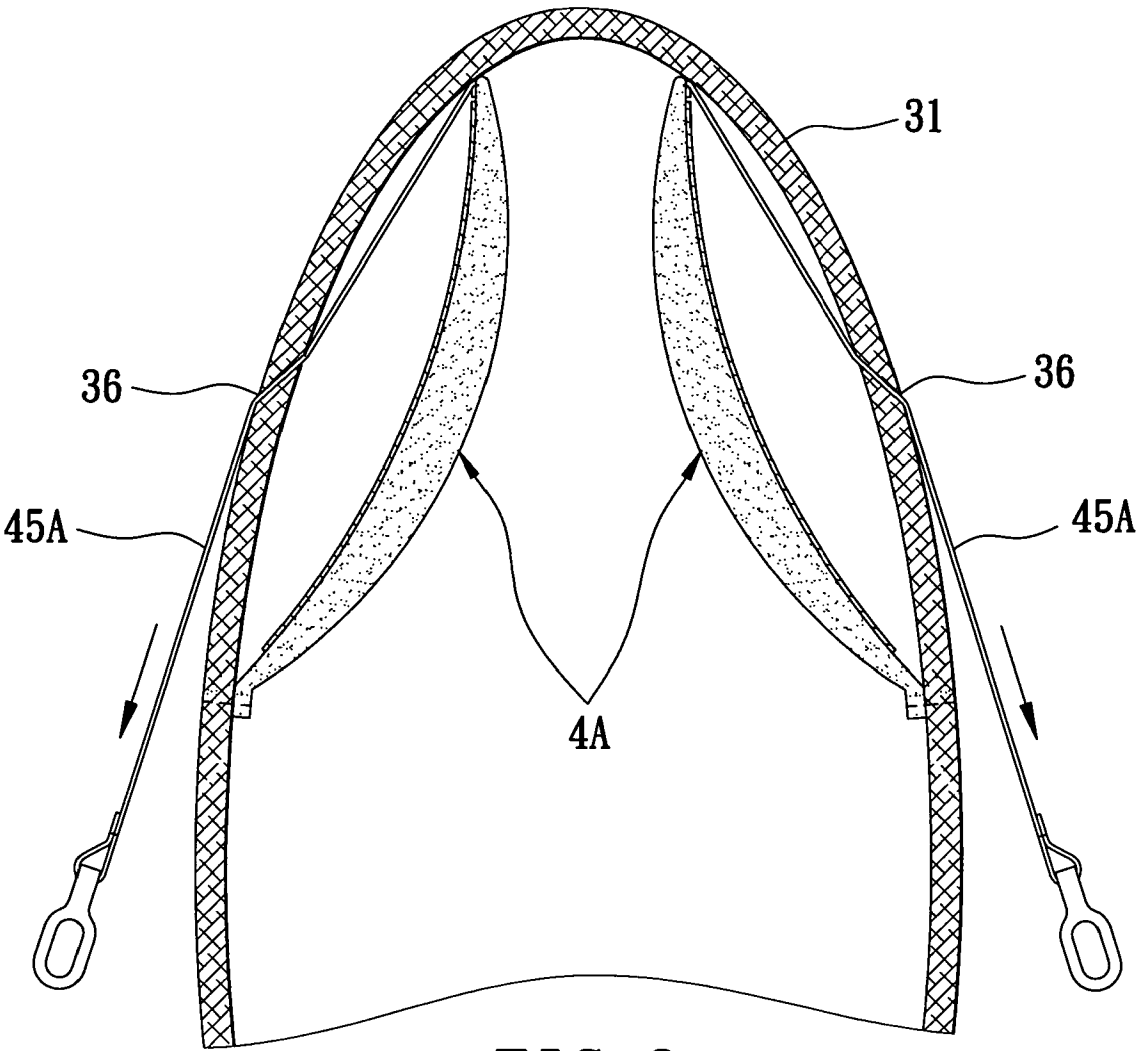
FIG. 8 is the same view as FIG. 7 but with the adjustment pads being moved inward.

Referring to FIGS. 7 and 8, a fourth preferred embodiment of the present invention includes two adjustment pads 4A each of which has one end attached to the rear wall 31 by using a stitch line 42A as a connecting member. A free end of each adjustment pad 4A is connected to a strap 45A which passes through the through hole or the strap passage unit 36. Like the adjustment pad 4" of the third embodiment, each adjustment pad 4A has a backing 401A and a soft pad 402A.

When the straps 45A are pulled, the adjustment pads 4A are bent and moved inward as shown in FIG. 8. Due to the elastic property of the backings 401A, the adjustment pads 4A can return to its original positions when the straps 45A are released.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

We claim:

1. A shoe comprising:

an upper including a front portion, a heel portion which has a rear wall adapted to extend around the heel of a foot, and an instep part provided with a shoelace;

at least one adjustment pad attached loosely to said rear wall within said heel portion and including an intermediate part, first and second ends on two opposite sides of said intermediate part, a first surface confronting said rear wall, and a second surface opposite to said first surface;

first and second strap passage units provided on said rear wall, said first strap passage unit being proximate to said second end of said adjustment pad; and a strap including a first section connected to said first surface of said adjustment pad at least at a location adjacent to said second end, and a second section passing through said first and second strap passage units, said second section having one end extending out of said upper and connected to said shoelace, wherein said first section of said strap is connected to said first surface of said adjustment and adjacent to said first end and said second end, said strap being folded between said first and second sections adjacent to said second end, wherein, when said shoelace is tightened, said strap is pulled and tensed between said first and second passage units and moves inward said intermediate part of said adjustment pad.

2. The shoe as claimed in claim 1, wherein said first strap passage unit includes a ring member attached to said rear wall adjacent to said second end of said adjustment pad, said second strap passage unit including a through hole formed in said rear wall for said second section of said strap to extend outward.

3. The shoe as claimed in claim 1, further comprising a connecting member having one end attached to said rear wall, and another end attached to said adjustment pad adjacent to said first end.

4. The shoe as claimed in claim 3, wherein said connecting member is an elastic strip.

5. The shoe as claimed in claim 1, wherein said adjustment pad further includes a retainer provided on said adjustment pad adjacent to said second end, said retainer connecting said first section of said strap to said adjustment pad.

6. The shoe as claimed in claim 5, wherein said retainer includes a short strip having two ends attached to said first surface of said adjustment pad, and an aperture defined between said short fabric strip and said first surface to receive said strap.

7. The shoe as claimed in claim 5, wherein said retainer is formed with at least two slots extending through said adjustment pad from said first surface to said second surface adjacent to said second end, said first section of said strap extending through one of said slots from said first surface to said second surface and then through the other one of said slots from said second surface to said first surface.

8. The shoe as claimed in claim 1, wherein said adjustment pad includes a backing and a soft pad overlying said backing.

* * * * *